US006346214B1

(12) United States Patent
Knudsen et al.

(10) Patent No.: US 6,346,214 B1
(45) Date of Patent: Feb. 12, 2002

(54) TOP HAT FURNACE

(75) Inventors: Arne-Nils Knudsen, Stolberg; Siegfried Wilden, Simmerath, both of (DE)

(73) Assignee: Otto Junker GmbH (DE)

( * ) Notice: Subject to any disclaimer, the term of this patent is extended or adjusted under 35 U.S.C. 154(b) by 0 days.

(21) Appl. No.: 09/581,489

(22) PCT Filed: Aug. 31, 1999

(86) PCT No.: PCT/DE99/02718

§ 371 Date: Aug. 21, 2000

§ 102(e) Date: Aug. 21, 2000

(87) PCT Pub. No.: WO00/22178

PCT Pub. Date: Apr. 20, 2000

(30) Foreign Application Priority Data

Oct. 14, 1998 (DE) ..... 198 47 417

(51) Int. Cl.[7] ..... C21D 1/06

(52) U.S. Cl. ..... 266/256; 266/252

(58) Field of Search ..... 266/256, 249, 266/252

(56) References Cited

FOREIGN PATENT DOCUMENTS

| | | | |
|---|---|---|---|
| DE | 3233815 | * | 3/1984 |
| WO | WO 98/33946 | * | 8/1998 |

* cited by examiner

*Primary Examiner*—Scott Kastler
(74) *Attorney, Agent, or Firm*—David C. Purdue; John C. Purdue

(57) ABSTRACT

A top hat annealing furnace with pivoting features. The annealing furnace has an annealing understructure, an annealing hood, a heating hood and a cooling hood. The annealing understructure and the annealing hood are supported so that they can be tilted between an operating position and a loading position. The heating hood and the cooling hood are provided with doors, which can be closed when the furnace is in use, and opened when it cycle is completed. When the doors of either hood are open and the hood is oriented vertically, the hood can be moved horizontally relative to the annealing hood.

18 Claims, 2 Drawing Sheets

TOP HAT FURNACE

This application is a 371 of PCT/DE99/02718 filed on Aug. 31, 1999.

DESCRIPTION

The invention relates to a top-hat furnace system for annealing metal coils, having an annealing understructure, which is seated on a furnace foundation and on which at least one metal coil can be placed with its coiling axis vertical, and having an annealing hood, which can be placed in a sealing manner on the annealing understructure and over which a heating hood or alternatively a cooling hood can be placed.

To anneal metal coils, use is made of "top-hat" annealing furnaces. These are manufactured by various firms, Junker, Ebner and LOI inter alia. The prior art described below can be found in brochures published by the above firms, e.g. the Ebner Journal, Volume 2, (September 1998). A system made by Junker is known from 1978, this system likewise being described in a company advertising publication.

The term metal coils in this context should be taken to mean bundles or rings of strips, wires and tubes. In this context, the metal coils are arranged on an annealing understructure in such a way that their coiling axis is vertical. A plurality of coils is generally stacked one above the other, being separated from one another by an intermediate layer, a so-called convector plate or convector star. An annealing hood connected in a sealing manner to the annealing understructure is then placed over the coil or coils, allowing the interior of the annealing hood to be supplied with a protective gas. To heat the annealing hood including the annealing stock, i.e. the metal coils, a heating hood fitted with appropriate heating devices is placed over the annealing hood.

Once annealing has been completed, the heating hood is removed again and replaced by a cooling hood, which ensures accelerated cooling of the annealing hood and of the annealing stock in it.

Placement of the metal coils on the annealing understructure and placement of the hoods is performed by means of a crane system.

For handling with conventional transportation means, e.g. fork-lift trucks, the metal coils are mounted in such a way that their coiling axis is horizontal. This makes it possible, for example, to insert the lifting arms of a fork-lift truck into the coil and thus raise and transport the latter easily. If appropriate, they may also be removed from a rolling stand and conveyed directly to the top-hat furnace system by the crane using a so-called C hook. To place a coil in a top-hat furnace, it must therefore be turned by 90° out of its transportation position. For this purpose, use is made of a so-called tilting cradle. The tilting cradle has an arbor or a similar guide element onto which the metal coil is first of all placed, if appropriate after a convector plate has been placed on top. The tilting cradle is mounted so as to be tiltable at one side and, after a metal coil has been placed on it, it is tilted by 90°, with the result that the coiling axis of the coil now occupies a vertical position.

The coil is then clasped and raised with special tongs or the convector plate on which the coil may then already be resting is raised by means of crane hooks and chains, which simultaneously support the coil laterally, and the coil is moved to the annealing understructure of the top-hat furnace and placed on this understructure. The convector plates must have the necessary strength for this purpose, i.e. they must be dimensioned to be raised with a coil. For the top-hat furnace, they thus represent a quantity of "dead" material which has to be heated with the rest.

The annealing hood, the heating hood and the cooling hood are provided with corresponding lifting lugs, allowing them likewise to be raised and transferred by means of the crane. Guide means connected to the annealing understructure are furthermore required during placement to ensure the exact position of the coils and the hoods.

The handling of the coils and the hoods as described requires considerable investment for the top-hat furnace system. For work with a crane, for instance, the shop must have a corresponding height or the annealing understructure must be arranged in correspondingly deep foundation pits. Despite the helpful guide means, precise placement of the coils and hoods and their removal on completion of annealing require experienced and continuously alert operating personnel and are indeed not without risk.

The object on which the invention is based is to specify a top-hat furnace system which requires less investment and which makes it possible to operate more quickly, more economically and with less risk.

According to the invention, the object is achieved by virtue of the fact that at least one arbor extending normal to the base surface of the annealing understructure is mounted on said annealing understructure, the annealing understructure, including the annealing hood and the metal coil or coils, is mounted in such a way as to be tiltable by 90° between a vertical and a horizontal position, the annealing hood can be placed on the annealing understructure and removed from the latter in its horizontal position, both the heating hood and the cooling hood are provided laterally with opening and closing means, giving rise to an opening which allows through the annealing hood, and both the heating hood and the cooling hood can be moved in a vertical position horizontally relative to the annealing hood.

It is preferable if the pivot about which the annealing understructure can be tilted is located horizontally in an imaginary plane passing vertically through the base surface of the annealing understructure. The closer the tilting point is moved toward the center of gravity of the annealing understructure, the shorter is the tilting lever and hence the force that has to be applied to tilt the annealing understructure. Tilting can be performed with conventional hydraulic systems.

It is expedient if the heating hood and the cooling hood are provided with a door to open one side. The door can be of single-or double-wing design and be mounted on hinges on the hoods. It can also be configured as a flap that can be raised. It is possible, for example, for the hoods to be movable on rails.

It is now possible to dispense with an expensive crane system or deep foundation pits for loading and unloading the top-hat furnace and for transporting the hoods. The metal coils are placed on the guide means of the annealing understructure, which is tilted up by 90°, in their customary transportation position, i.e. with their coiling axis horizontal. If appropriate, they are conveyed to the annealing understructure directly from a rolling stand on a C hook of a simple traveling trolley. For this purpose, the arbors on the annealing understructure are slotted in the axial direction, allowing the C hook to run into these slots in order to deposit the coils. By virtue of the configuration of the top-hat furnace system in accordance with the invention, it is even possible to automate this process.

If the intention is to place a plurality of coils one above the other in the furnace, a convector plate is placed between each pair of coils during loading but this convector plate must now only be dimensioned in such a way that it can withstand the pressure of the coil or coils above it. After loading the coils, the annealing hood is placed on the annealing understructure in a horizontal position over the coils and connected to said understructure. For this purpose, a transportation vehicle based on the principle of a fork-lift truck or, once again, the traveling trolley can be provided, for example. The annealing understructure, including the annealing hood and the metal coils accommodated therein, is then tilted back by 90° into the vertical position.

It is in this position that annealing is performed. For this purpose, the opened heating hood is first of all moved over the annealing hood in a vertical position and then closed. After annealing, the heating hood is replaced by a cooling hood of similar construction. Since a number of furnace systems are generally accommodated in one shop, the operating cycle can be chosen so that one furnace system is being loaded or unloaded while another one is annealing and a third is in the cooling mode.

Times for loading and unloading the top-hat furnaces and changing the hoods can be reduced considerably compared with the previous method.

There is also no longer any need to handle the metal coils with tongs, which always presented a risk of surface damage to the annealing stock.

Finally, safety for workers is improved throughout the entire handling process.

The invention will be explained in greater detail with reference to an exemplary embodiment.

In the associated drawings,

Figure 1:
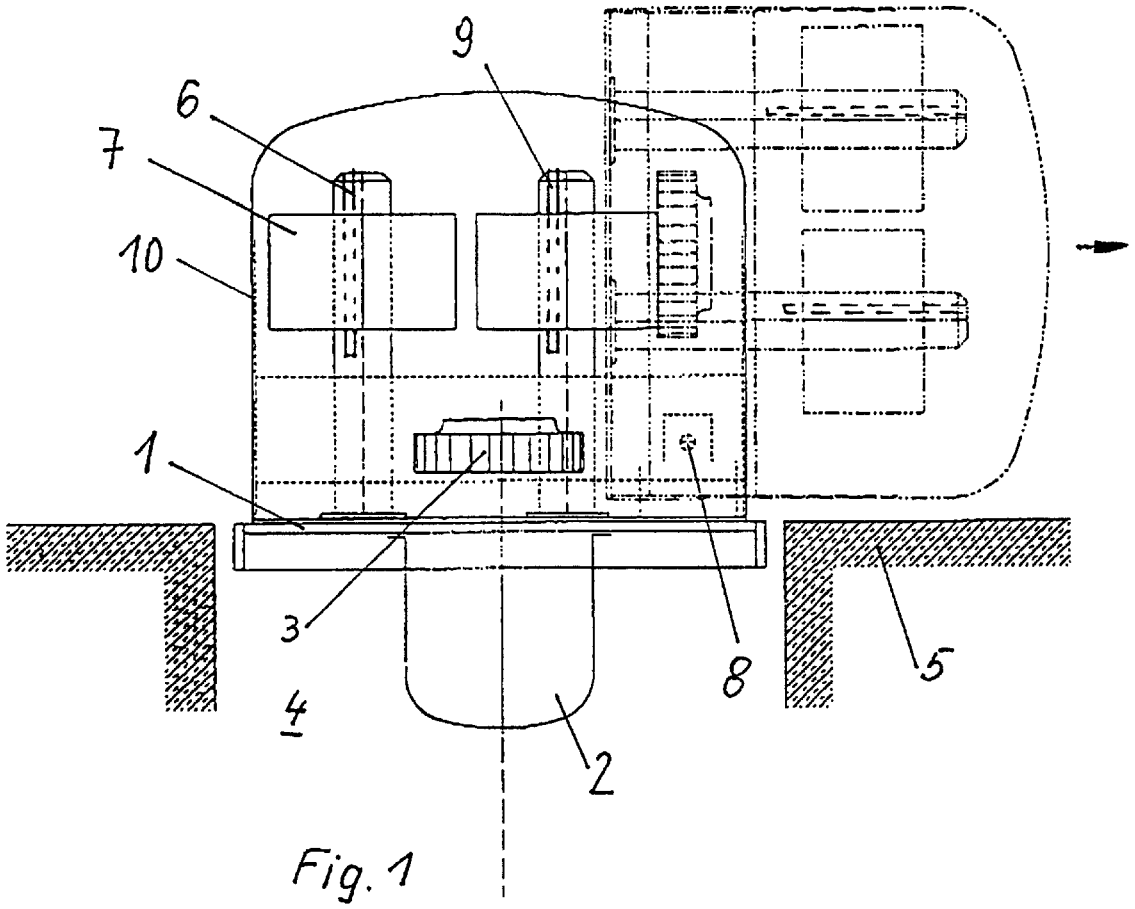
FIG. 1 shows the annealing understructure according to the invention with the annealing hood mounted on in a schematic side view and FIG. 2 shows a heating hood placed over the annealing hood in a schematic plan view.

According to FIG. 1, an annealing understructure 1 rests on a furnace foundation (not shown specifically here). Substructures 2 mounted on the annealing understructure and intended for supply equipment, e.g. feed lines for air and for protective gas and for mounting a fan 3, project into a foundation pit 4 recessed into the floor 5 of a production shop.

Mounted on the annealing understructure 1 are arbors 6, the diameters of which correspond to the inside diameter of the metal coils 7.

To load metal coils 7, the annealing understructure 1, which is mounted on a pivot 8, is tilted by 90°. In this position, it can now be loaded with the metal coils 7. The drawing indicates slots 9, into which a corresponding C hook of a traveling trolley can run. An annealing hood 10 is then placed on in a horizontal position and connected in a sealing manner to the annealing understructure 1. In FIG. 1, the system is shown in broken lines in this arrangement, the substructures 2 having been omitted for reasons of clarity.

After loading and the placement of the annealing hood 10, the annealing understructure 1 is tilted back into its working position. Conventional hydraulic systems (not shown here) are provided, for example, for tilting.

Figure 2:
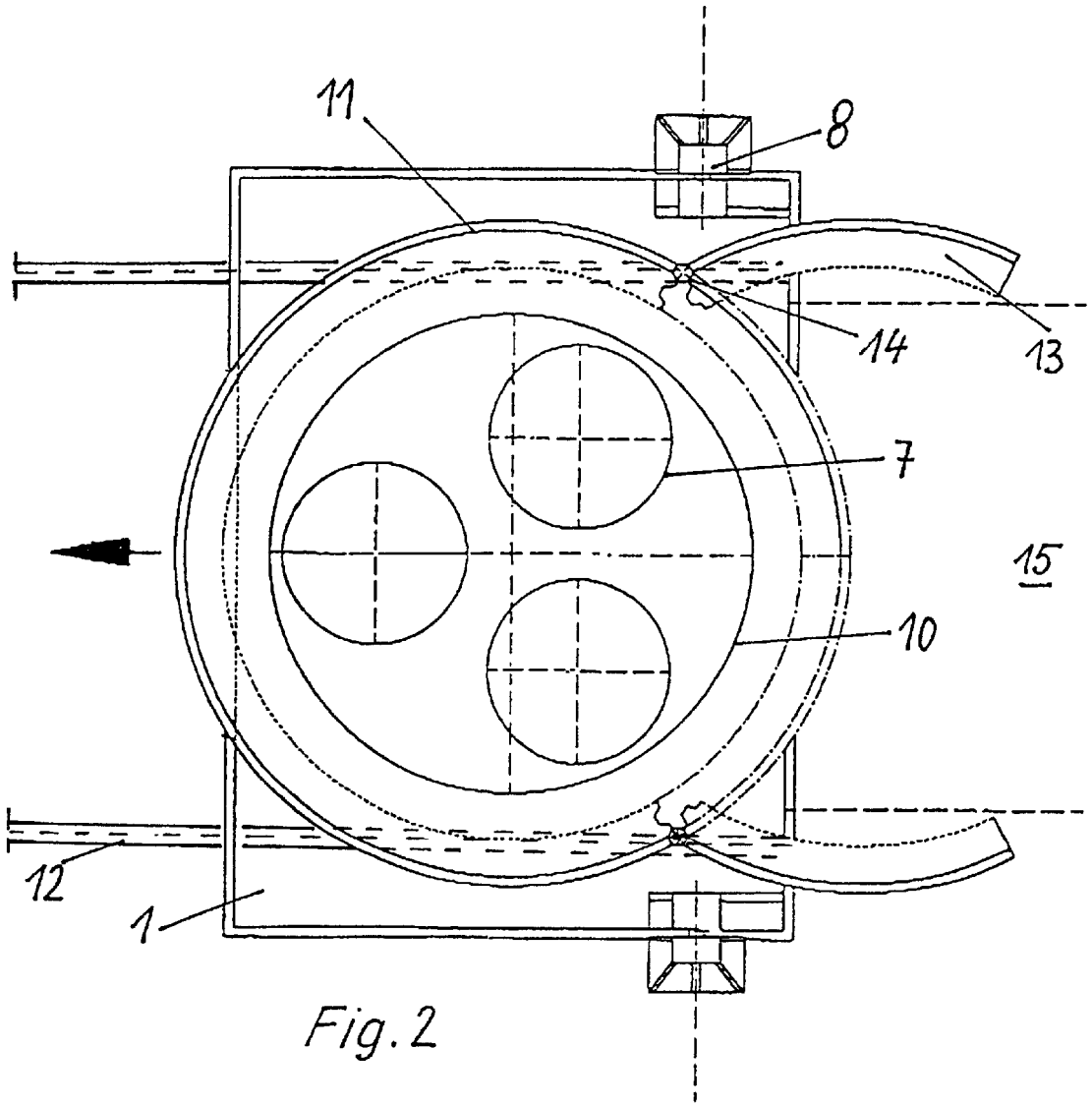

A heating hood 11, shown in FIG. 2, is then placed over the annealing hood 10 in order to anneal the metal coils 7. The heating hood 11 can be moved on rails 12 and has a two-wing door 13 mounted on door hinges 14. Once the door 13 has been closed, annealing can begin.

Once annealing is complete, the heating hood 11 is then replaced by a cooling hood (not shown here), this cooling hood again being provided with a door.

After cooling and after the annealing understructure 1 has been tilted up by 90° again and the annealing hood 10 has been removed, the bright-annealed metal coils 7 can be removed. The loading space 15 for these operations is indicated in FIG. 2.

What is claimed is:

1. A top hat furnace system for annealing metal coils (7), having an annealing understructure (1), which is seated on a furnace foundation and on which at least one metal coil (7) can be placed with its coiling axis vertical, and having an annealing hood (10), which can be placed in a sealing manner on the annealing in understructure (1) and over which a heating hood (11) or alternatively a cooling hood can be placed, wherein at least one arbor (6) extending normal to the base surface of the annealing understructure (1) is mounted on said annealing understructure, wherein the annealing understructure (1), including the annealing hood (10) and the metal coil or coils (7), is mounted in such a way as to be tiltable by 90° between a vertical and a horizontal position, wherein the annealing hood (10) can be placed on the annealing understructure (1) and removed from the latter in its horizontal position, wherein both the heating hood (11) and the cooling hood are provided laterally with opening and closing means for defining an opening through which the annealing hood (10) can pass, and wherein both the heating hood (11) and the cooling hood can be moved in a vertical position horizontally relative to the annealing hood (10).

2. The top-hat furnace system as claimed in claim 1, wherein the pivot about which the annealing understructure (1) can be tilted is located horizontally in an imaginary plane passing vertically through the base surface of the annealing understructure (1).

3. The top-hat furnace system as claimed in claim 1 or 2, wherein the annealing understructure (1) can be tilted hydraulically.

4. The top-hat furnace system as claimed in claim 1 or 2, wherein the heating hood (11) and the cooling hood each have a door (13) for opening and closing one side.

5. The top-hat furnace system as claimed in claim 3, wherein the heating hood (11) and the cooling hood each have a door (13) for opening and closing one side.

6. The top-hat furnace system as claimed in claim 1 or 2, wherein the heating hood (11) and the cooling hood can each be moved on rails (12).

7. The top-hat furnace system as claimed in claim 3, wherein the heating hood (11) and the cooling hood can each be moved on rails (12).

8. The top-hat furnace system as claimed in claim 4, wherein the heating hood (11) and the cooling hood can each be moved on rails (12).

9. The top-hat furnace system as claimed in claim 5, wherein the heating hood (11) and the cooling hood can each be moved on rails (12).

10. The top-hat furnace system as claimed in claim 1 or 2, wherein the arbor or arbors (6) are slotted in the axial direction.

11. The top-hat furnace system as claimed in claim 3, wherein the arbor or arbors (6) are slotted in the axial direction.

12. The top-hat furnace system as claimed in claim 4, wherein the arbor or arbors (6) are slotted in the axial direction.

13. The top-hat furnace system as claimed in claim 5, wherein the arbor or arbors (6) are slotted in the axial direction.

14. The top-hat furnace system as claimed in claim 6, wherein the arbor or arbors (6) are slotted in the axial direction.

15. The top-hat furnace system as claimed in claim 7, wherein the arbor or arbors (6) are slotted in the axial direction.

16. The top-hat furnace system as claimed in claim 8, wherein the arbor or arbors (6) are slotted in the axial direction.

17. The top-hat furnace system as claimed in claim 9, wherein the arbor or arbors (6) are slotted in the axial direction.

18. A top hat furnace system for annealing metal coils (7), having an annealing understructure (1), which is seated on a furnace foundation and on which at least one metal coil (7) can be placed with its coiling axis vertical, and having all annealing hood (10), which can be placed in a sealing manner on the annealing understructure (1) and over which a heating hood (11) or alternatively a cooling hood can be placed, wherein at least one arbor (6) extending normal to the base surface of the annealing understructure (1) is mounted on said annealing understructure, wherein the annealing understructure (1), including the annealing hood (10) and the metal coil or coils (7), is mounted in such a way as to be tiltable between a vertical and a horizontal position, wherein the annealing hood (10) can be placed on the annealing understructure (1) and removed from the latter in its horizontal position, wherein both the heating hood (11) and the cooling hood are provided laterally with at least one door defining an opening through which the annealing hood (10) can pass, and wherein both the heating hood (11) and the cooling hood can be moved in a vertical position horizontally relative to the annealing hood (10).

* * * * *